US011813580B2

(12) United States Patent
Zenke et al.

(10) Patent No.: US 11,813,580 B2
(45) Date of Patent: Nov. 14, 2023

(54) STATIC MIXER SUITABLE FOR ADDITIVE MANUFACTURING

(71) Applicant: NOV CANADA ULC, Calgary (CA)

(72) Inventors: Luke C. Zenke, Sherwood Park (CA); Ross Edward Brice, Spruce Grove (CA)

(73) Assignee: NOV CANADA ULC, Calgary (CA)

( * ) Notice: Subject to any disclaimer, the term of this patent is extended or adjusted under 35 U.S.C. 154(b) by 212 days.

(21) Appl. No.: 16/948,090

(22) Filed: Sep. 2, 2020

(65) Prior Publication Data

US 2022/0062835 A1 Mar. 3, 2022

(51) Int. Cl.
*B01F 25/431* (2022.01)

(52) U.S. Cl.
CPC .... *B01F 25/43161* (2022.01); *B01F 25/4318* (2022.01); *B01F 25/43171* (2022.01); *B01F 25/431974* (2022.01)

(58) Field of Classification Search
CPC ..... B01F 25/43161; B01F 25/43171; B01F 25/4318; B01F 25/431974; B01F 25/43162; B01F 25/3131
USPC ..... 366/336–340
See application file for complete search history.

(56) References Cited

U.S. PATENT DOCUMENTS 3,912,426 A 10/1975 Tschirky
4,061,313 A * 12/1977 Brauner ..... B01F 25/4524 366/340
4,062,524 A * 12/1977 Brauner ..... B01F 25/43161 138/37
4,220,416 A * 9/1980 Brauner ..... B01F 25/43151 366/337
4,264,790 A 4/1981 Zlevor
4,878,624 A * 11/1989 Psaltopoulos ..... B01F 25/4315 366/337
4,958,790 A 9/1990 Nix et al.
D333,296 S 2/1993 Stedham
(Continued)

FOREIGN PATENT DOCUMENTS

CH 706732 A2 * 1/2014 ..... B01F 5/0619
CH 717741 A2 * 2/2022 ..... B01F 25/43161
(Continued)

OTHER PUBLICATIONS

"U.S. Appl. No. 16/595,281, Non-Final Office Action dated Apr. 2, 2021", 23 pgs.
(Continued)

*Primary Examiner* — Charles Cooley
(74) *Attorney, Agent, or Firm* — Schwegman Lundberg & Woessner, P.A.

(57) ABSTRACT

A static mixer may include a housing having an inlet and an outlet. The static mixer may also include a mixing element arranged within the housing. The mixing element may include a plurality of blade disk pairs arranged in crisscrossing fashion, each blade disk, of the pairs of blade disks, comprising a plurality of parallel extending and spaced apart blades. In some examples, a blade disk may include a link connecting the end of each of the plurality of parallel extending and spaced apart blades. In some examples, the link may be a ring base. In other examples, the link may be a propped tie. Alternatively or additionally, a support perch may be provided for supporting a ring base of an adjoining module.

19 Claims, 17 Drawing Sheets

(56) References Cited

U.S. PATENT DOCUMENTS 5,222,013 A 6/1993 Schwalm
5,222,334 A 6/1993 Hasty
5,300,734 A 4/1994 Suzuki
5,378,063 A * 1/1995 Tsukada ..... B01F 25/43151 366/337
5,484,203 A * 1/1996 King ..... B01F 25/43151 366/337
5,564,827 A * 10/1996 Signer ..... B29C 48/362 366/340
5,620,252 A * 4/1997 Maurer ..... B01F 25/43161 366/337
5,639,993 A 6/1997 Ideno et al.
5,688,047 A * 11/1997 Signer ..... B01F 25/43161 366/337
D396,639 S 8/1998 Pedersen-Rask
5,807,087 A 9/1998 Brandt et al.
D419,961 S 2/2000 Weatherill
6,382,930 B1 5/2002 Bahnen et al.
6,394,644 B1 * 5/2002 Streiff ..... B01F 35/561 366/337
6,467,949 B1 10/2002 Reeder et al.
6,637,928 B2 * 10/2003 Schuchardt ..... B29B 7/325 366/337
6,793,192 B2 * 9/2004 Verbrugge ..... B29C 45/26 264/318
6,967,285 B2 11/2005 Sanroma et al.
D523,333 S 6/2006 Moretti
D578,393 S 10/2008 Canamasas
D631,185 S 1/2011 Ku et al.
D640,248 S 6/2011 Baumann et al.
D647,059 S 10/2011 Guo
8,491,180 B2 * 7/2013 Hirschberg ..... B01F 23/47 366/337
8,496,456 B2 7/2013 Ree
D693,774 S 11/2013 Scime
D698,023 S 1/2014 Iseberg et al.
8,753,006 B2 * 6/2014 Habibi-Naimi ..... B29C 44/00 366/337
D733,690 S 7/2015 Zukowski
D734,292 S 7/2015 Barone
9,197,956 B2 11/2015 Iseberg et al.
D769,708 S 10/2016 Smith
D817,935 S 5/2018 Zukowski
D852,143 S 6/2019 Ku
D860,954 S 9/2019 Ishiguro et al.
D904,316 S 12/2020 Cartmill et al.
10,882,014 B2 * 1/2021 Hug ..... B01F 25/43161
2003/0155436 A1 * 8/2003 Nilsen ..... B01D 53/1462 239/427
2003/0165080 A1 * 9/2003 Pinyayev ..... B29C 45/33 366/337
2004/0114461 A1 * 6/2004 Fuglister ..... B01F 25/4316 366/337
2004/0125691 A1 7/2004 Streiff et al.
2005/0169779 A1 8/2005 Bratu
2012/0106290 A1 * 5/2012 Meijer ..... B01F 25/43161 366/337
2012/0134232 A1 * 5/2012 Schneider ..... B29B 7/325 422/310
2013/0021870 A1 * 1/2013 Linne ..... B01F 25/4321 366/337
2013/0107660 A1 * 5/2013 Pappalardo ..... B01F 25/4321 29/527.1
2013/0135963 A1 * 5/2013 Linne ..... B01F 25/4316 366/337
2013/0277116 A1 10/2013 Knull et al.
2015/0064037 A1 3/2015 Kourakos et al.
2016/0036212 A1 2/2016 Murakami
2016/0084085 A1 3/2016 Eisner
2016/0126712 A1 5/2016 Markham et al.
2016/0247609 A1 8/2016 Wang et al.
2016/0254079 A1 9/2016 Musick
2016/0273534 A1 9/2016 Melo et al.
2017/0207615 A1 7/2017 Trapassi et al.
2017/0314443 A1 * 11/2017 Simon ..... F01N 3/2066
2017/0314444 A1 * 11/2017 Yi ..... B01F 23/2132
2017/0314552 A1 11/2017 Rothschild et al.
2018/0126929 A1 5/2018 Miller et al.
2018/0257047 A1 * 9/2018 Pappalardo ..... B29C 45/44
2019/0076800 A1 * 3/2019 Nieuwoudt ..... B01F 25/4231
2020/0254401 A1 8/2020 Hug et al.
2021/0102464 A1 4/2021 Brice et al.
2022/0062835 A1 * 3/2022 Zenke ..... B01F 25/43161
2023/0219046 A1 * 7/2023 Streiff ..... B01F 25/4231 366/337

FOREIGN PATENT DOCUMENTS

DE 2316127 A1 10/1974
DE 202016100894 U1 4/2016
EP 1426099 A1 * 6/2004 ..... B01F 5/0617
EP 1815904 A1 * 8/2007 ..... B01F 15/00935
EP 3495036 A1 * 6/2019 ..... B01F 5/0619
GB 1235262 A 6/1971
GB 2021199 A 11/1979
KR 20040075579 8/2004
WO WO-2005005836 A1 1/2005
WO WO-2008/091262 A1 7/2008
WO WO-2010060225 A1 * 6/2010 ..... B01F 13/002
WO WO-2010/108487 A2 9/2010
WO WO-2020257033 A1 12/2020

OTHER PUBLICATIONS

"U.S. Appl. No. 29/650,528, Restriction Requirement dated Feb. 24, 2021", 8 pgs.
"International Application Serial No. PCT/US2020/037088, International Search Report dated Sep. 2, 2020", 3 pgs.
"International Application Serial No. PCT/US2020/037088, Written Opinion dated Sep. 2, 2020", 5 pgs.
U.S. Appl. No. 29/650,528, filed Jun. 7, 2018, Connection Boot.
U.S. Appl. No. 16/595,281, filed Oct. 7, 2019, Hybrid Core Progressive Cavity Pump.
"U.S. Appl. No. 16/595,281, Response filed Jul. 2, 2021 to Non Final Office Action dated Apr. 2, 2021", 11 pgs.
"U.S. Appl. No. 16/595,281, Final Office Action dated Jul. 14, 2021", 24 pgs.
"U.S. Appl. No. 16/595,281, Examiner Interview Summary dated Sep. 22, 2021", 2 pgs.
"U.S. Appl. No. 16/595,281, Response filed Oct. 13, 2021 to Final Office Action dated Jul. 14, 2021", 8 pgs.
"U.S. Appl. No. 16/595,281, Notice of Allowance dated Oct. 27, 2021", 8 pgs.
"U.S. Appl. No. 16/595,281, Corrected Notice of Allowability dated Jan. 21, 2022", 2 pgs.
"International Application Serial No. PCT/CA2021/000075, International Search Report dated Nov. 23, 2021", 4 pgs.
"International Application Serial No. PCT/CA2021/000075, Written Opinion dated Nov. 23, 2021", 7 pgs.
"International Application Serial No. PCT/US2020/037088, International Preliminary Report on Patentability dated Dec. 30, 2021", 7 pgs.
"Kenics—Advanced Static Mixing Technology, KMX-V Mixer", National Oil Well Varco, Internet, vol. Bulletin 805, [online]. Retrieved from the Internet: <URL: https://www.environmentalexpert.com/downloads/kenics-kmx-v-static-mixers-brochure-633887>, (2013), 2 pgs.
"Kenics—Static Mixer Technology", National Oil Well Varco, vol. Bulletin 200, Rev 02, [online]. Retrieved from the Internet: <URL: https://www.chemineer.com/products/kenics/hevmixers/item/download/498_92dbac57b6110550a0b2d40068bd441f.html>, (2015), 12 pgs.
Karl, Kolmetz, "Static Mixer Selection, Sizing and Troubleshooting (Engineering Design Guidelines)", Internet, Rev 02, [online]. Retrieved from the Internet: <URL: https://www.klmtechgroup.com/PDF EDG-SYS/ENGINEERING-DESIGN-GUIDELINESstatic-mixer-Rev2.1/web.pdf>, (Apr. 2014), 23 pgs.

(56) References Cited

OTHER PUBLICATIONS

"International Application Serial No. PCT CA2021 000075, International Preliminary Report on Patentability dated Mar. 16, 2023", 9 pgs.

* cited by examiner

STATIC MIXER SUITABLE FOR ADDITIVE MANUFACTURING

FIELD OF THE INVENTION

The present application relates to fluid mixing. More particularly, the present application relates to static mixing of fluid where fluid is routed through a conduit have a static mixing element arranged therein. Still more particularly, the present application relates to particular mixing elements types and arrangements for use in static mixing of fluid.

BACKGROUND OF THE INVENTION

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Static mixing of fluid may involve routing a fluid through a conduit where the conduit includes a mixing element arranged within the conduit. The mixing element may create one or a series of tortuous pathways particularly adapted to induce shear stresses in the fluid as the fluid passes through the conduit. In many cases, the fluid may include a primary fluid and an additive and the purpose of the mixer may be to blend the additive into the primary fluid. In some cases, the additive may be added to the primary fluid just prior to the primary fluid's entry into the static mixer such that the primary fluid and additive enter the mixer together and in an unblended state. The mixer may then blend the two fluids as they pass through the mixer such that a blended fluid exits the mixer.

The mixing element may include sets of blade fingers spaced from one another like an unconnected grate. Each mixing element may include multiple blade sets. At particular locations along the length of the mixing element, pairs of blade sets may be arranged in an interlocking arrangement where one blade set is arranged at an angle to direction of flow such as at 45 degrees to the direction of flow and the other blade set is arranged at an angle to the direction of flow such as −45 degrees to the direction of flow. When viewed from the side (e.g., across the blade set where the blade fingers are arranged behind one another, the two blade sets may form an 'X' shape, for example. Multiple pairs of blade sets arranged as described may be arranged along the length of the conduit to form a mixing element.

Manufacture of the above-described mixing elements may be time consuming, complicated, and costly. Moreover, adjustments in the design to accommodate particular mixing requirements, pressures, and mixing efficiencies may exacerbate the manufacturing issues by forcing reconsideration of the manufacturing process for each new design.

BRIEF SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, a static mixer may include a housing having an inlet and an outlet. The static mixer may also include a mixing element arranged within the housing. The mixing element may include a plurality of blade disk pairs arranged in crisscrossing fashion, each blade disk, of the pairs of blade disks, comprising a plurality of parallel extending and spaced apart blades.

In one or more embodiments, a static mixing element may include a plurality of mixing element modules. The modules may include a plurality of blade disk pairs arranged in crisscrossing fashion, each blade disk, of the pairs of blade disks, comprising a plurality of parallel extending and spaced apart blades.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present application, in one or more embodiments, relates to static mixers having mixing elements arranged therein. The presently described mixing elements may include one or more disks arranged at opposite angles relative to a direction of flow. The disks may include multiple blades spaced apart from one another to form a grate. At least one end of each of the multiple blades may be connected to an adjacent blade via a link and causing the multiple blades to be unitary with one another to form the disk. One or more disks may be arranged in groups to form a module of a mixing element and when the modules are stacked or arranged end-to-end, they may form a mixing element.

Figure 1:
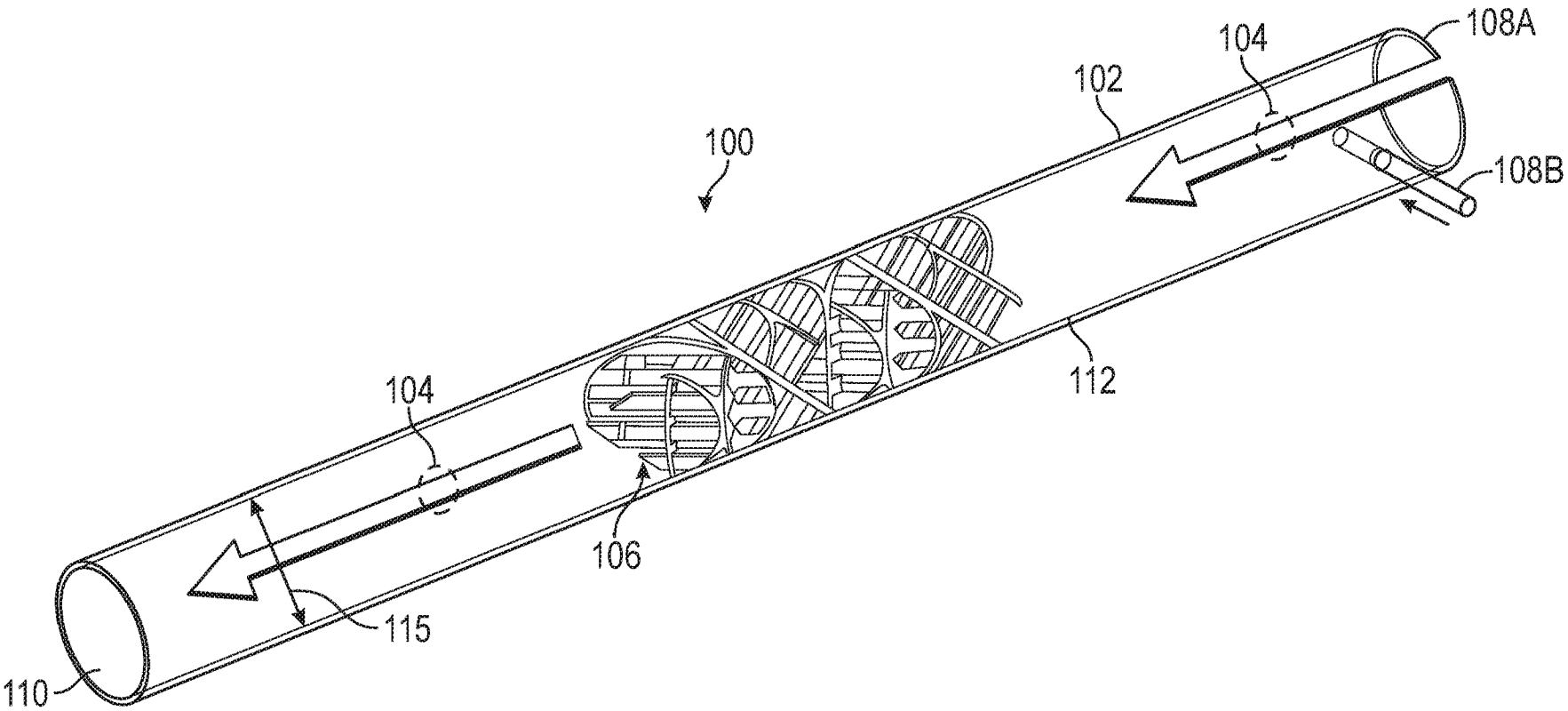
FIG. 1 is a perspective view of a static mixer, according to one or more embodiments.

Referring to FIG. 1, a static mixer is shown. The static mixer may be configured to receive a primary fluid and an additive. The static mixer may be particularly adapted to route the primary fluid and additive through a conduit having a static mixing element arranged therein such that flow of the primary fluid and additive through the static mixer mixes the fluids. With continued reference to FIG. 1, the static mixer may include a housing 102 and a mixing element 106.

The housing 102 may be adapted to contain fluid and may define a fluid pathway 104 for fluid to pass therethrough. The housing 102 may also be adapted to hold and/or contain a mixing element 106 in the fluid pathway. The housing 102 may include one or more inlets 108A/B and an outlet 110 and may have a sidewall 112 extending between the inlets 108A/B and the outlet 110. The sidewall 112 may have a cylindrical cross-section, square cross-section, triangular cross-section, or another closed-shape cross-section may be provided. The sidewall 112 may have an outer surface and an inner surface offset from the outer surface by a thickness. The inner surface may define a lumen 115 extending between the inlets and the outlet and defining the fluid pathway 104. The lumen 115 may be sized and configured for surrounding the mixing element 106. In one or more embodiments, the housing 102 may include an internal rib or other internal feature for supporting and/or limiting the position of the mixing element 106 within the housing. The housing 102 may be steel, aluminum, steel and/or aluminum alloy, composite materials, cementitious materials, or other materials. The material and thickness of the housing 102 may be selected based on anticipated internal pressures, connections to surrounding fluid handling equipment, corrosivity of processing fluids and other factors.

The one or more inlets 108A/B may be adapted for receiving the primary fluid and one or more additives and for combining the several streams of fluid. The outlet 110 may be adapted for emitting a mixed fluid after the combined streams have been blended by the mixing element 106. In one or more embodiments, the additives or other fluids may be added to the primary fluid prior to entrance into the housing 102 in which case the housing 102 may have a single inlet, for example, for receiving the combined and unblended streams of fluid. In this case, the inlet of the housing 102 may be an open receiving end of the housing. In other embodiments, the additives or other fluids may be added to the primary fluid within the length of the housing 102. In these embodiments, the primary fluid inlet 108A may include, for example, an open receiving end of the housing 102 and the additive or secondary fluid inlets 108B may be provided through the sidewall 112 of the housing 102 in the form of pipe nipples, hose barbs, flanged connections, or other types of inlets adapted for connection of additive fluid lines, for example. The additive or secondary fluid inlets 108B may also include valves for controlling the rate of the additive flow. The outlet 110 may be arranged downstream of the primary and additive inlets 108A/B and may include a generally open trailing end of the housing 102. In one or more embodiments, the primary fluid inlet and the outlet may include pipe flanges allowing the static mixer 100 to be secured within a piping arrangement, for example.

Figure 2:
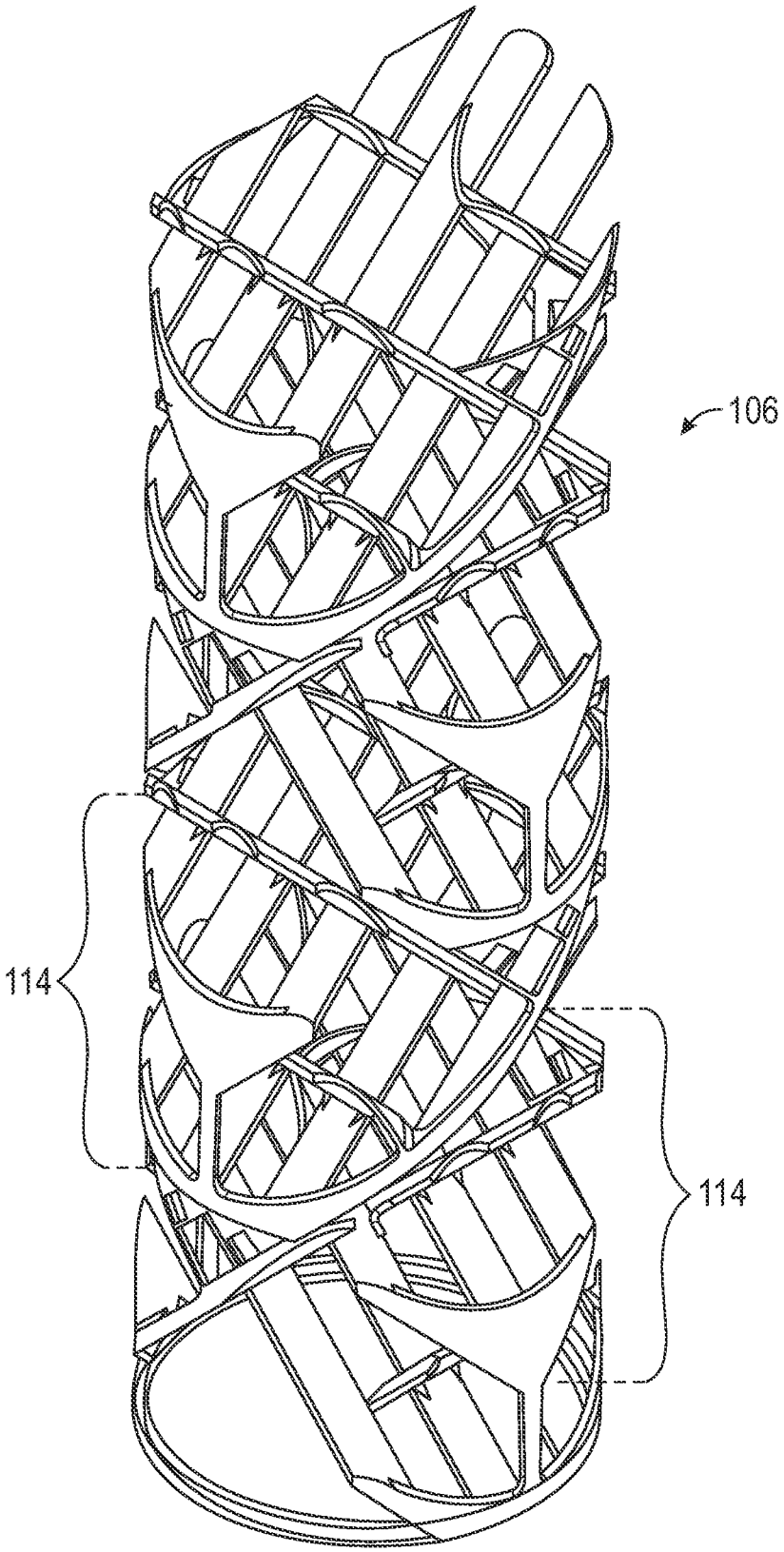
FIG. 2 is perspective view of a mixing element for use in a static mixer, according to one or more embodiments.
Figure 3:
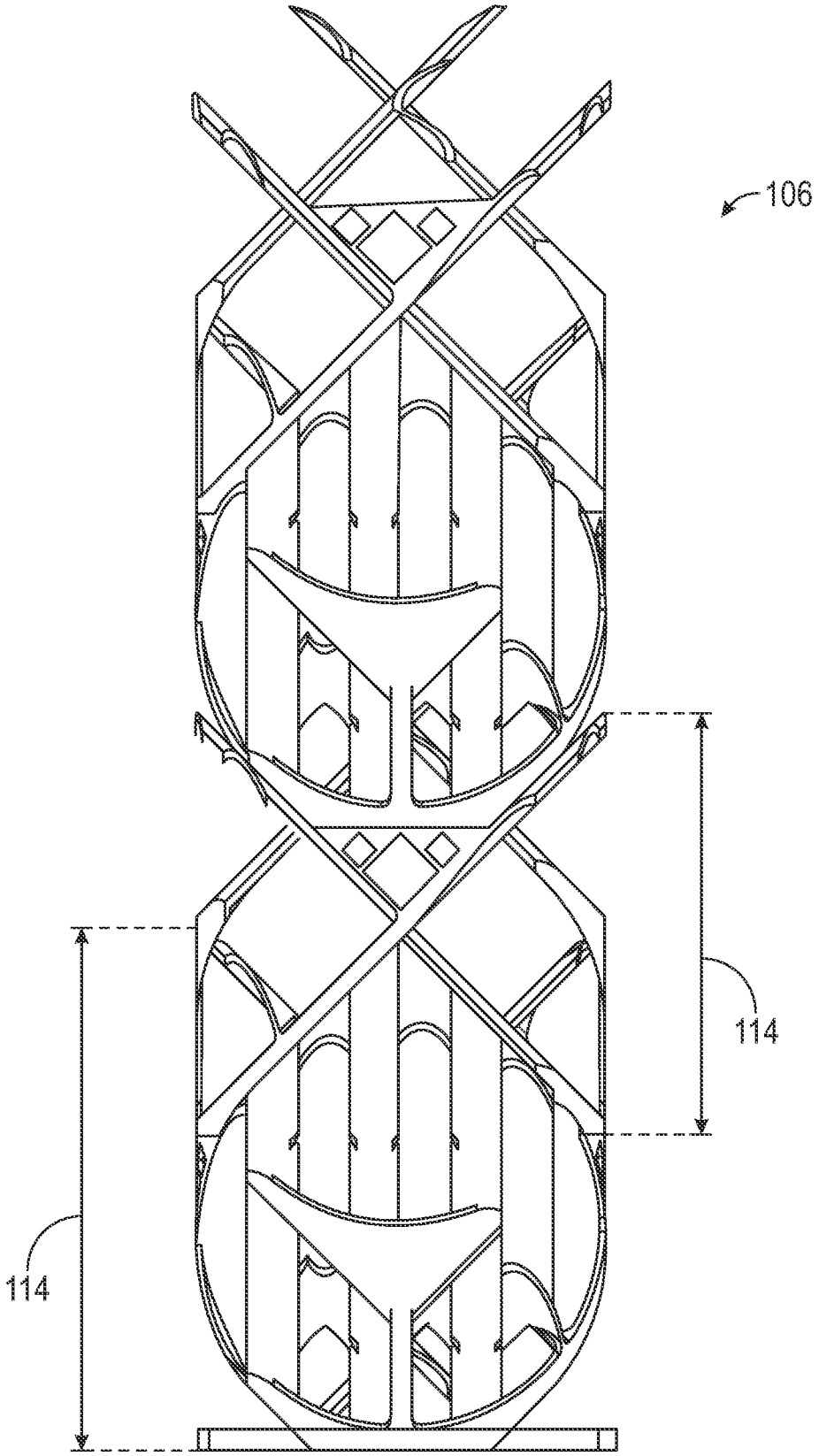
FIG. 3 is a side view thereof.
Figure 4:
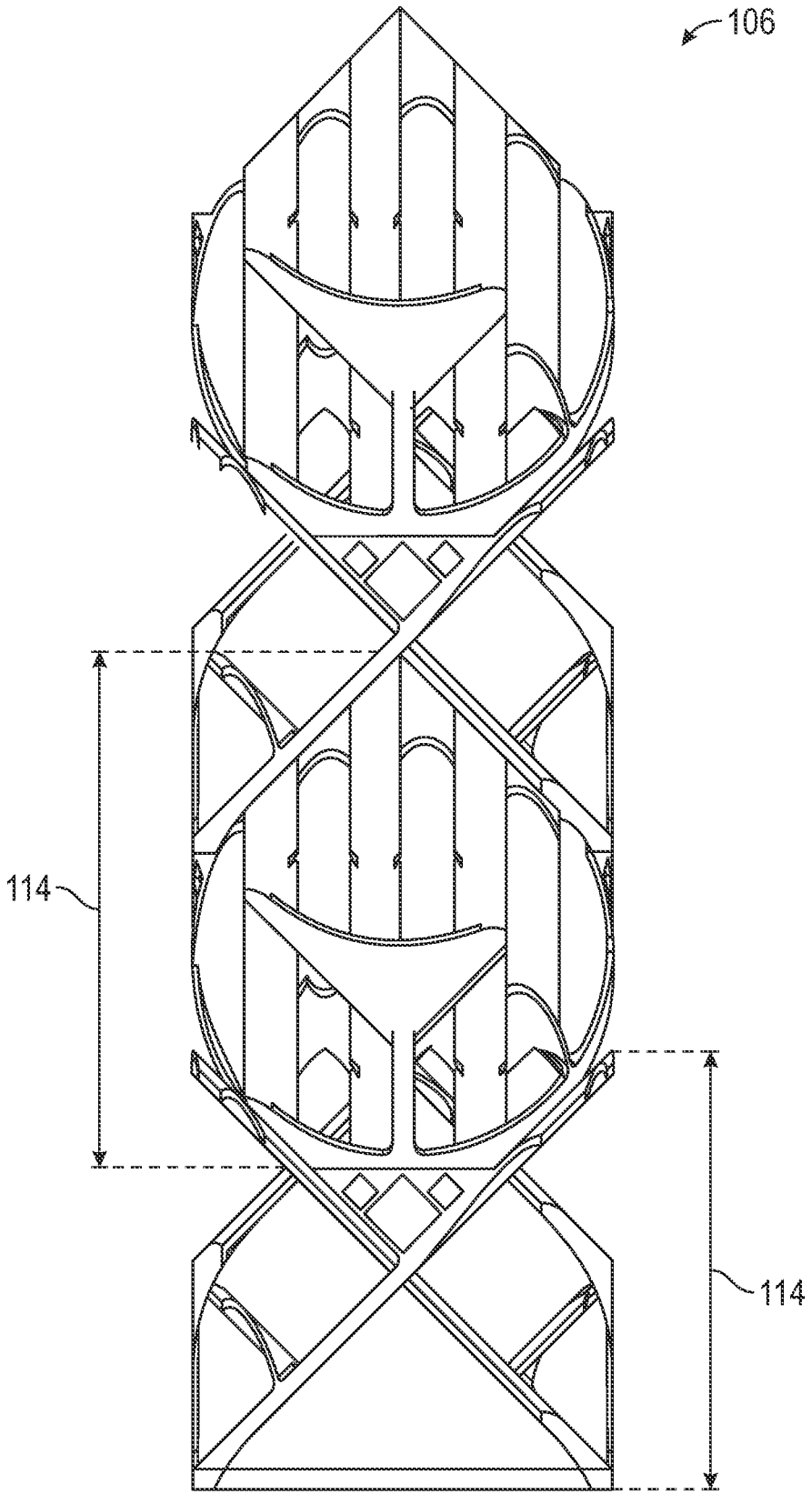
FIG. 4 is a front view thereof.

With continued reference to FIG. 1, a mixing element 106 may be arranged within the housing 102. The mixing element 106 may be a substantially stationary mixing element 106 arranged within the housing 102 and configured to create shear stresses in the fluid or fluids passing therethrough. As shown in isolation in FIG. 2, the mixing element 106 may include a plurality of stackable modules 114 defining a repeating pattern of mixing blades. In one or more embodiments, the modules 114 may be adapted for stacking in alternating orientations as shown by comparing FIGS. 3 and 4, which are side and front views, respectively, and, as such, are substantially orthogonal views of the mixing element 106. While the mixing element 106 is shown to be modular, nothing shall require that the mixing element be modular and the several aspects of the module discussed below shall be understood to be available as part of a non-modular mixing element. Moreover, even in the case of a modular mixing element, it should be understood that one or more modules may be manufactured as a single unitary mixing element. Still further, and for example, depending on the manufacturing facilities and equipment, multiple modules may be manufactured at one time as a single piece to form a segment of the mixing element and multiple segments may be assembled to form a longer mixing element. The modular and/or segmented nature of the mixing element may allow for most any length of mixing element to be manufactured.

Figure 5:
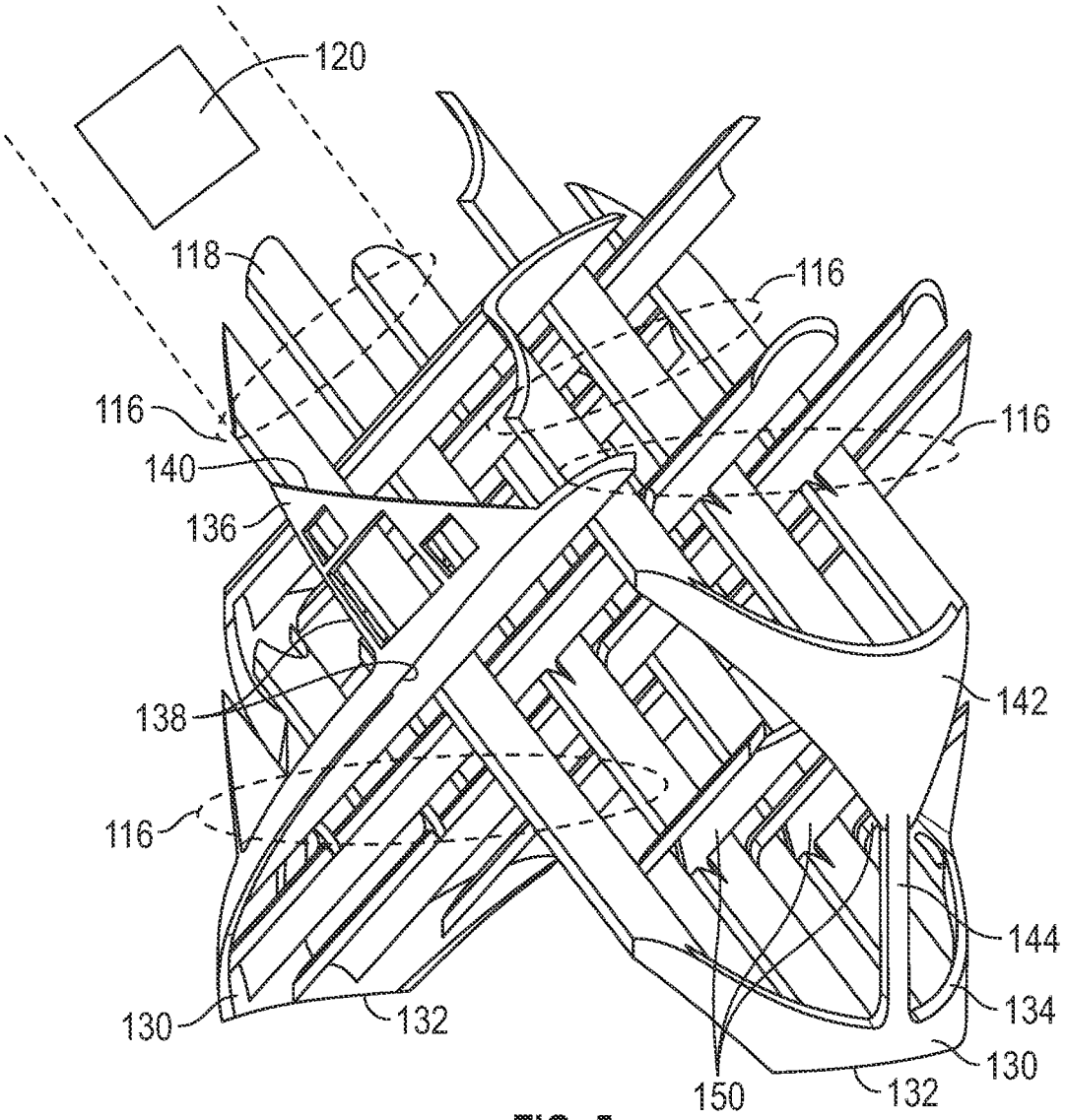
FIG. 5 is a perspective view of a module of the mixing element of FIG. 2, according to one or more embodiments.
Figure 6:
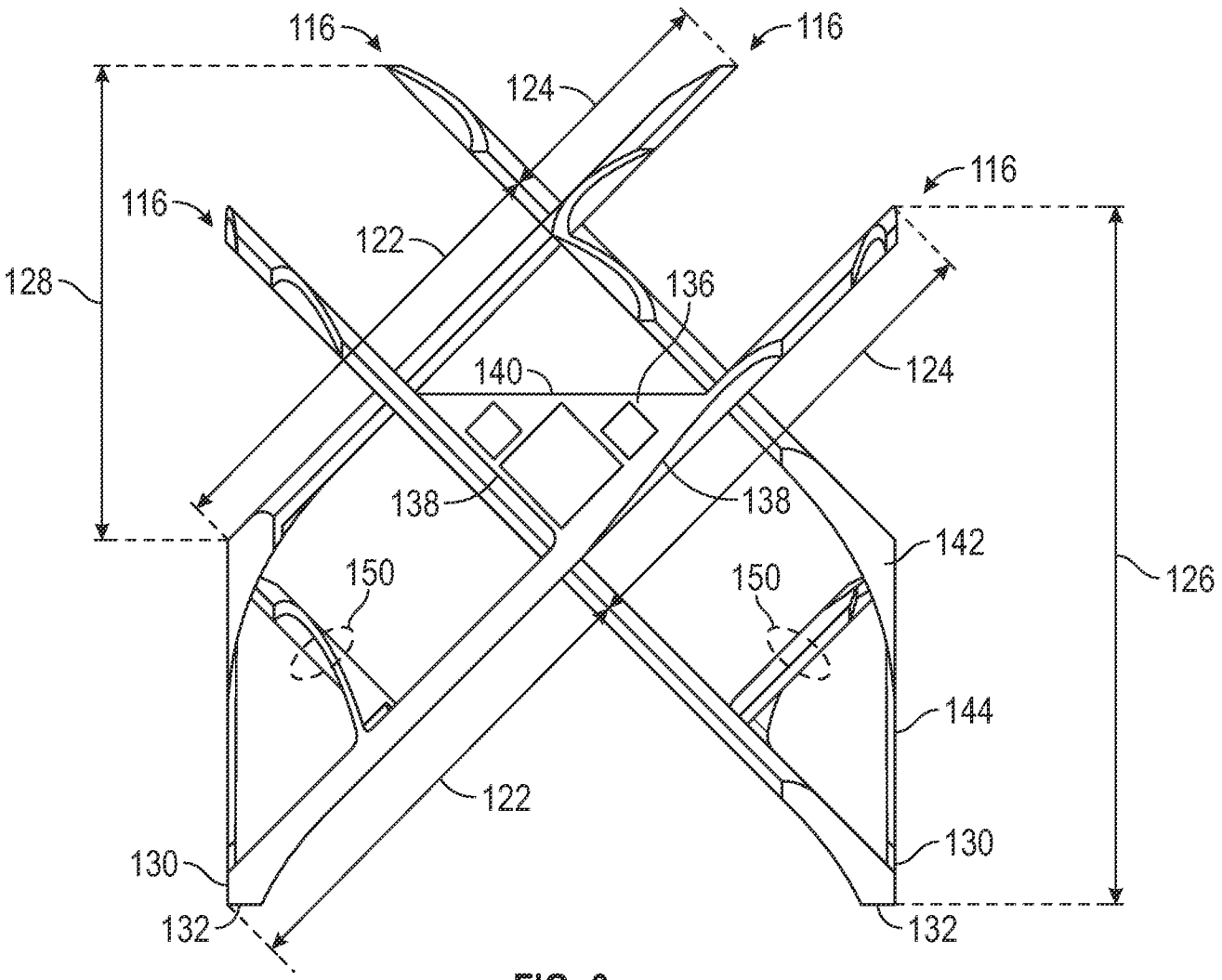
FIG. 6 is a side view thereof.

With reference now to FIG. 5, a perspective view of a module 114 of a mixing element 106 is shown. As shown, the module 114 may include a plurality of blade disks 116 arranged in a crisscross and interlocking pattern to create shear stresses in the fluid flowing through the module 114. Each blade disk may include a plurality of blades 118 arranged in parallel and spaced apart fashion in a disk plane 120. The spaced apart blades may allow for the crisscross pattern mentioned. For example, the module 114 may include four blade disks 116 arranged in pairs of two blade disks per pair. Each blade disk 116 of each pair may be arranged to crisscross the other blade disk in the pair. That is, the blade disks 116 of the pair may be arranged at a similar height within the overall height of the module and may be angled in opposite directions to form an X, when viewed from the side as shown in FIG. 6. The bottom portion of the X shape may include a plurality of blade legs 122 in each disk extending downward from the crossing point and diverging away from the plurality of blade legs 122 in the other disk in the pair. Similarly, the X shape may include a plurality of blade arms 124 (the arms being the other end of the blade as the legs) in each disk extending upward from the crossing point and diverging away from the plurality of blade arms 124 in the other disk in the pair. The spaced apart blade patterns of each disk in the pair may be staggered or shifted with respect to the blades in the other disk such that the blades of one disk extend between the blades of the other disk in the pair.

The blade disk pairs of the module 116 may include an upper pair 128 and a lower pair 126. Still further, the upper and lower blade disk pairs 128/126 may overlap such that the blade legs 122 of the blade disks in the upper pair 128 crisscrosses with the blade arms 124 of the blade disks in the lower pair 126 as shown in FIG. 6. The blades 118 of the blade disks may be trimmed at their ends to accommodate placement within the lumen 115 of the housing 102. In one or more embodiments, the blade disk ends may be elliptically shaped such that the module 116 as a whole is circular when viewed from above or below, for example. Still other lumen shapes may be accommodated by trimming the blade ends to fit within the lumen. It is noted that the length of the blades of the lower disk pair 126 in the module 116 may be limited mainly by their angle to the direction of flow, the size of the lumen, and the blades position across the width of the lumen. That is, each blade in the lower pair of disks may extend the full distance across the lumen and may be limited in length where it encounters the inner wall of the lumen on each end. In contrast, the blades of the upper disk pair 128 may have lengths selected to accommodate the legs 122 of the lower disk pair 126 of an adjoining module. That is, as shown in FIGS. 5 and 6, for example, the blade legs 122 of the upper disk pair 128 may extend to the lumen wall, but the blade arms 124 may stop short of full extension to the inner wall of the lumen. Instead, the blade arms 124 may stop as they encounter the blade leg profile of the adjoining module 114 arranged above. It is noted that the blade leg profile of the above module may be rotated 90 degrees from the present module 114 and as such, the length of the blade arms may be truncated accordingly.

The blades 118 of the blade disks 116 may be flat when viewed in cross-section. That is, for example, the cross-section of the blades may be rectangular. In one or more other embodiments, and as shown in FIGS. 2-7, the blades may have a substantially flat, but curved cross-section. As with the present embodiment, the curvature may be concave down. In other embodiments, the curvature may be concave up. In still other embodiments, the blades may have a v-shaped cross-section or another cross-section may be provided.

Figure 7:
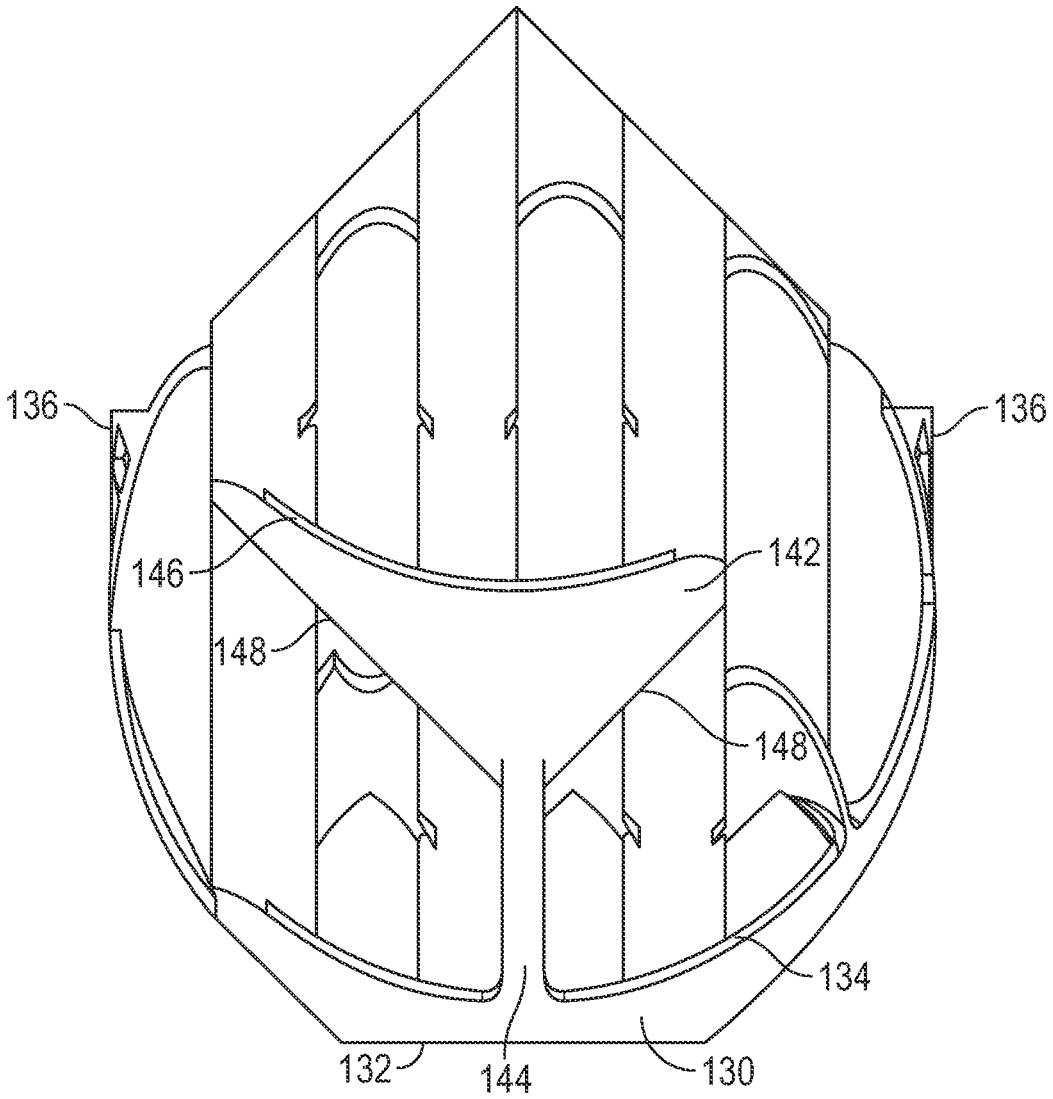
FIG. 7 is a front view thereof.

With reference again to FIG. 5, the module 114 may also be adapted for engagement with modules 114 above and below it. In the present embodiment, the module 114 may be particularly adapted at its lower end with a ring base 130 for each lower blade disk 116. The ring bases 130 may be well suited for support by a ring support. That is, for example, the ring bases 130 may include a link between the ends of the blade legs 122 in the bottom pair 126 of the module. The link may extend laterally around the periphery of the bottom ends of all of the blade legs 122 in the respective disk 116 forming a unitary object including the several blades 118 in the plane of the disk 116 and the link portion itself. The link may be adapted to sleevably fit within the housing 102 and, as such, may be in the form of a collar with an outer diameter just smaller than the inner diameter of the housing 102 and an inner diameter defined by a collar thickness. When viewed from above, the ring base 130 may include a segment of a circle or cylinder, for example. When viewed from the front as shown in FIG. 7, the ring base 130 may have a substantially flat bottom edge 132 and a curved top edge 134 adapted to provide an attachment point for each of the blade legs returning down to it. Due to the staggered nature of the blades 118, the blades 118 in the disks may not be symmetrical about the centerline and the ring base 130 may reach up higher along one side than the other to reach all of the blades in the disk 116. The ring base 130 may be well suited for resting on a support ring within the housing because of its flat bottom and otherwise cylindrical shape.

The module 114 may also be particularly adapted at its upper end with a partial ring support, such that another module with a ring base may be turned approximately 90 degrees relative to the present module and placed on top of the present module. That is, as shown in FIGS. 5 and 6, a support perch 136 may be arranged at or around the mid-height of the module 114. The support perch 136 may be arranged approximately 90 degrees out of phase with the ring base 130 as shown. That is, the support perch 136 may be positioned 90 degrees around the module 114 when viewed from above or below. The support perch 136 may be seated in the crux of the X of the lower pair of blade disks 116. In one or more embodiments, the support perch 136 may include a curved outer surface conforming to the inner curvature of the housing and may have a curved inner surface offset from the outer surface by a thickness. The support perch may have a V-shaped bottom edge 138 adapted for seating against one or more of the blades on the outer edge of the blade disks forming the X. In one or more embodiments, and due to the staggered nature of the blades forming the X, the perch 136 may be attached to one of the blades forming the X and not the other and, as such, one leg of the V-shaped bottom edge 138 may be a free edge. The support perch 136 may include a substantially flat top edge 140 when viewed from the side as in FIG. 6. The substantially flat top edge 140 may allow for resting thereon of another similarly shaped module 114. That is, for example, the ring base 130 of another module may rest on the flat top edge 140 of the perch 136. In one or more embodiments, the bottom edge 132 of the ring base 130 may have a length matching that of the top edge 140 of the support perch 136. While a flat bottom edge 132 of the ring base 130 and a flat top edge 140 of the perch 136 have been described, a curved joint or other joint may be provided where the shape of the bottom of the ring base 130 compliments the shape of the top edge of the perch 136. The use of a flat joint may be advantageous in avoiding a particular or different starter module, which may be adapted for sitting on a substantially flat ring support. However, a curved or otherwise adapted ring support may be provided to avoid a particular or different starter module.

With continued reference to FIG. 5 and FIG. 7, the upper pair 128 of blade disks 116 may have their respective blades connected with a link in the form of a propped tie 142. The propped tie 142 may be arranged above the ring base 130 and may be configured for supporting the blades 118 of the upper blade disk 116 in the module 114. As shown, the propped tie 142 may be supported by a vertically extending strut 144. The strut 144 may extend upward from the ring base 130 in the form of a support column, for example. The propped tie 142 may extend laterally around the periphery of the bottom edge of the blade legs 122 of the upper blade disks 116 forming a unitary object including the several blades in the respective upper blade disk 116 and the propped tie 142 itself. In one or more embodiments, as shown, the top edge 146 of the propped tie may reach to the height of each of the blades in the upper blade disk and, may have a curved upper surface due to the arrangement of the blades. The propped tie 142 may have a v-shaped bottom edge 148 reaching downward from the blade ends and converging toward the strut 144 and forming a tapered column capital on the top of the strut 144.

With continued reference to FIGS. 5 and 6, connecting plates 150 may also be provided. That is, as shown, and at about the mid-length of the blade legs 122 of the lower blade disks, a plurality of connecting plates 150 may be provided. The connecting plates 150 may be positioned as if an additional blade disk was positioned to crisscross the blade legs 122 of the lower disks. As such, the connecting plates 150 may be positioned in the spaces between the lower blade legs and may be arranged at angle so as to appear to crisscross the lower blade legs. As shown in FIG. 6, for example, where the blade disk angle is approximately 45 degrees to the flow path, the connecting plates 150 may extend substantially orthogonally to the lower blade legs 122 at about a mid-length of the blade legs 122 (e.g., the portion of the blades below the crisscross point of the lower blade disks). In one or more embodiments, the base of the connecting plates 150 may be v-shaped and the connecting plates may be connected at each side to the lower blade legs 122. The connecting plates 150 may extend upward and outward therefrom and be connected to the propped tie 142 at an upper most end thereof or may be truncated due to encountering the lumen wall, for example.

Figure 8:
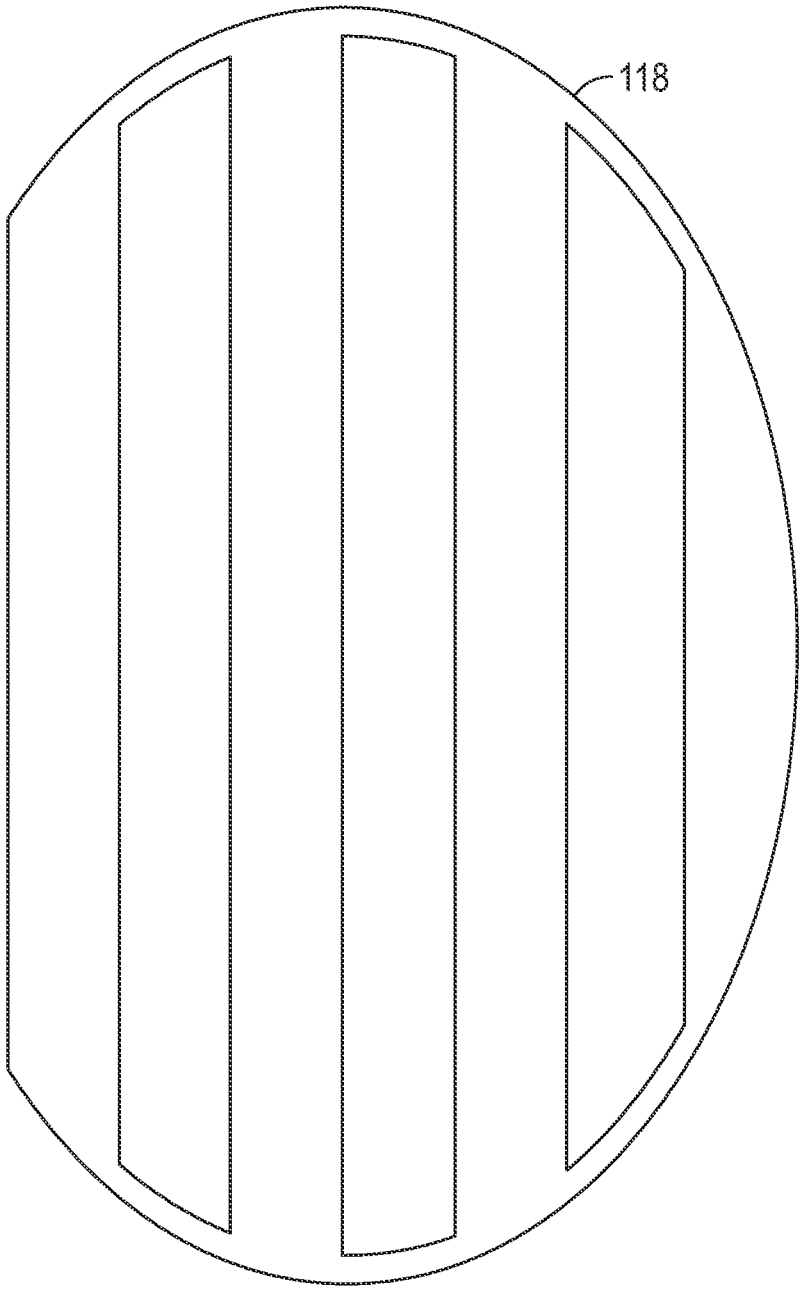
FIG. 8 is an orthogonal view of a disc of a mixing element, according to one or more embodiments.
Figure 9:
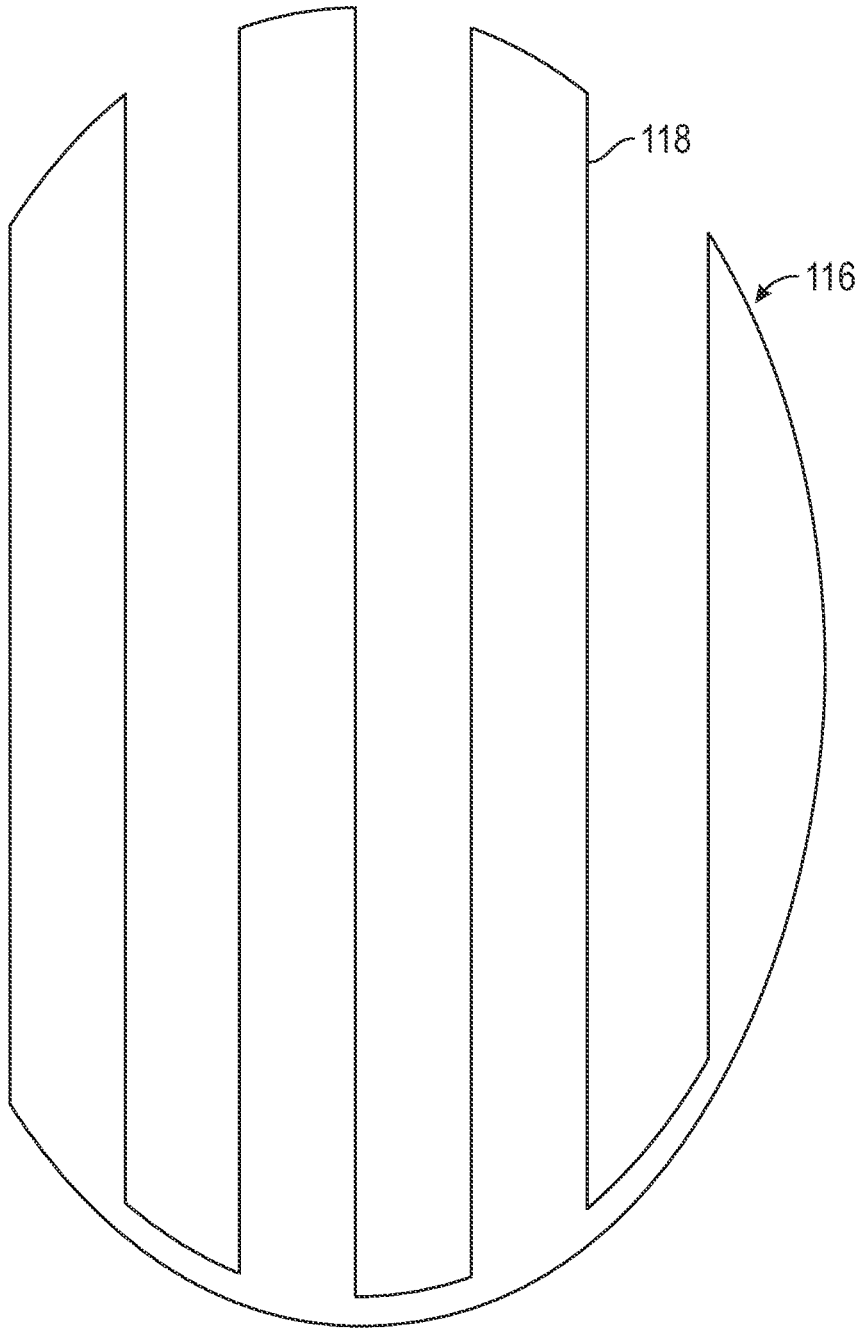
FIG. 9 is an orthogonal view of a disc of the mixing element of FIG. 2 and the module of FIG. 5.

Referring now to FIG. 8, a blade disk is shown where each end of the blade disks is connected with a link. In contrast, FIG. 9 is a blade disk 116 where a single end of the blade disks 116 is connected with a link. In either case, the present application shall be understood to refer to blade disks 116 where each of the blades 118 in the plane of the disk are connected to one another at at least one end, such as in FIG. 9. In contrast, blades in a single plane that are not connected at their ends, such as those shown in FIGS. 16A and 18A shall not be considered to be blade disks and instead are merely blade sets.

Figure 10:
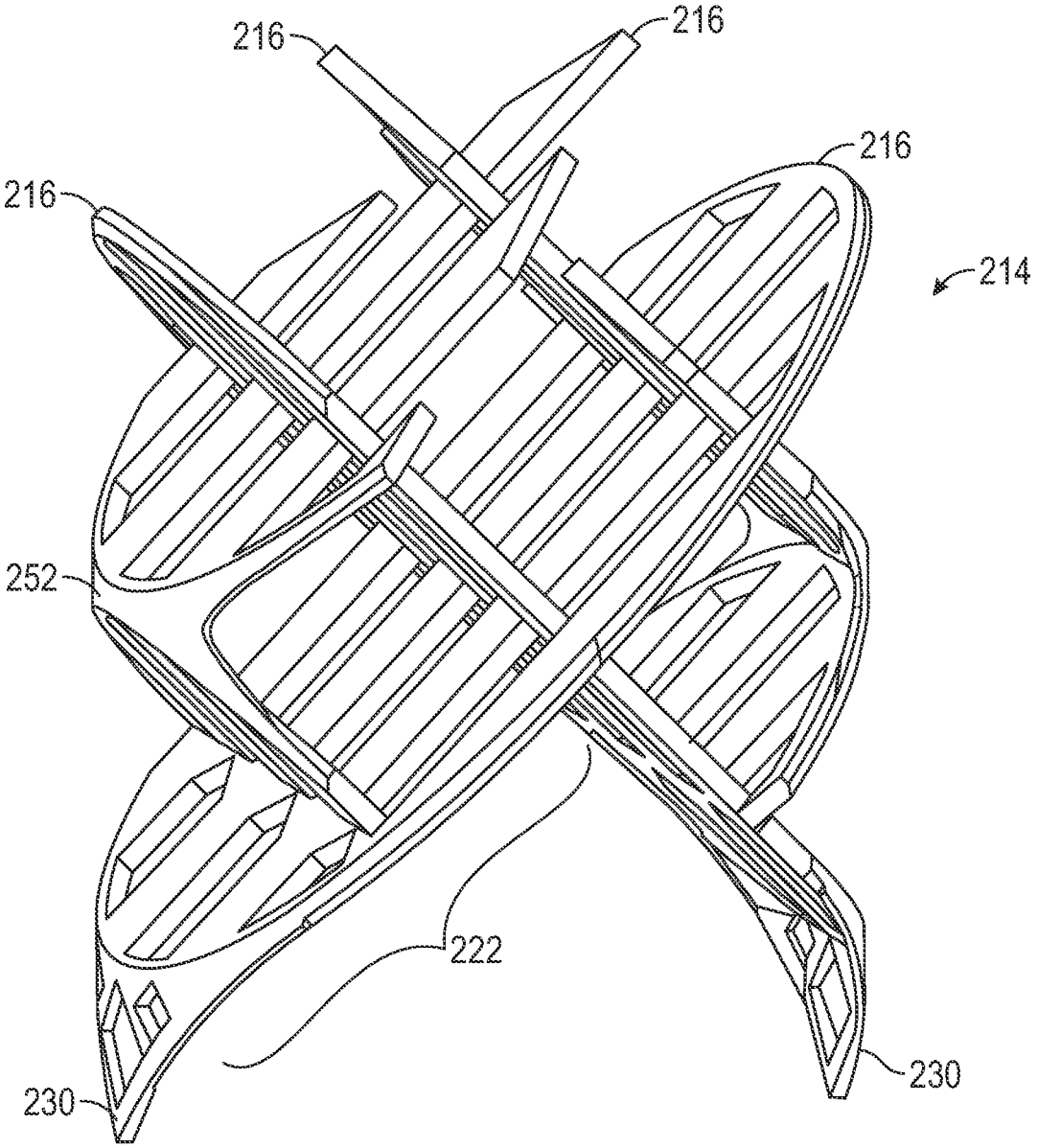
FIG. 10 is a perspective view of a module of a mixing element, according to one or more embodiments.
Figure 11:
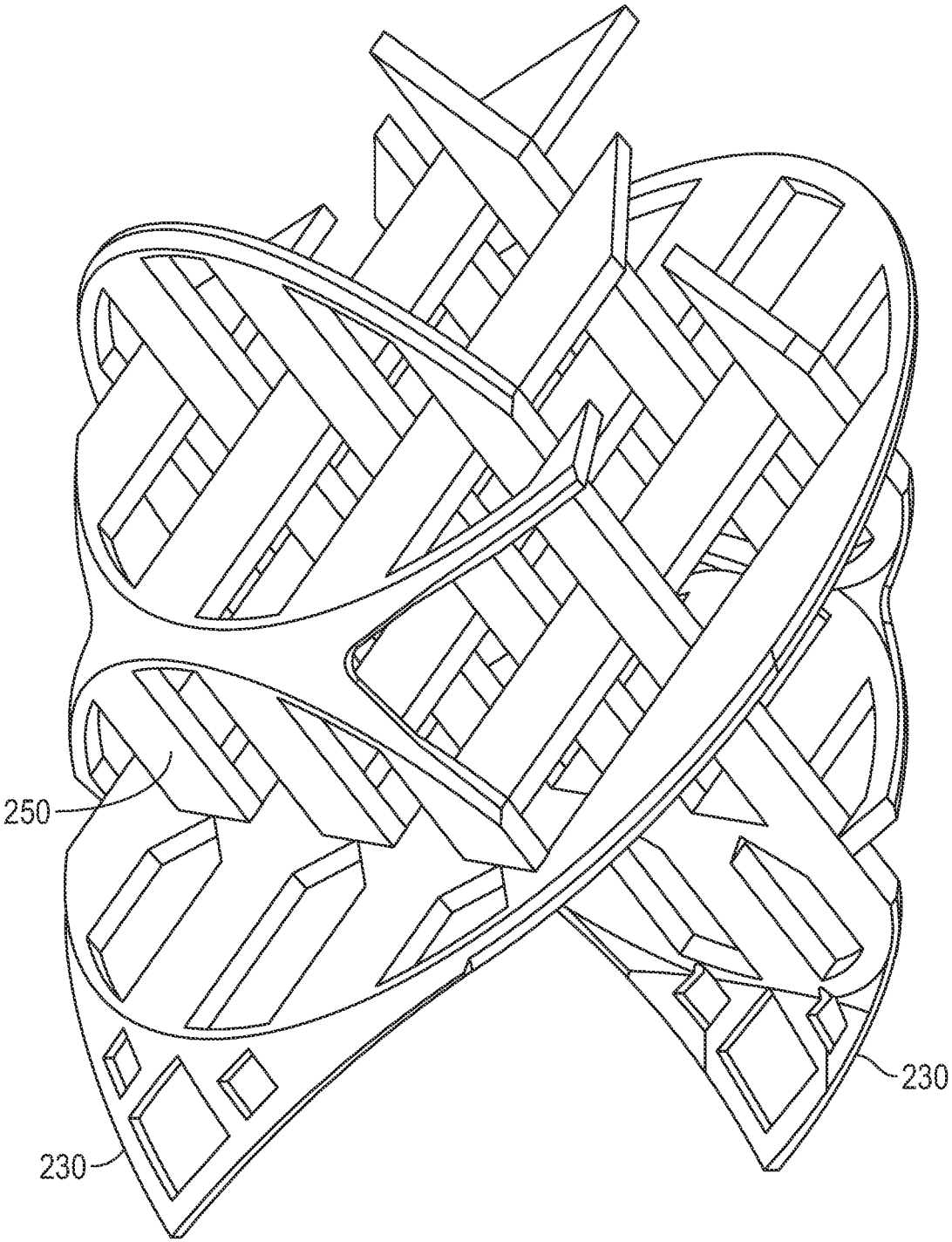
FIG. 11 is another perspective view of the module of FIG. 10 highlighting a connection feature thereof, according to one or more embodiments.
Figure 12:
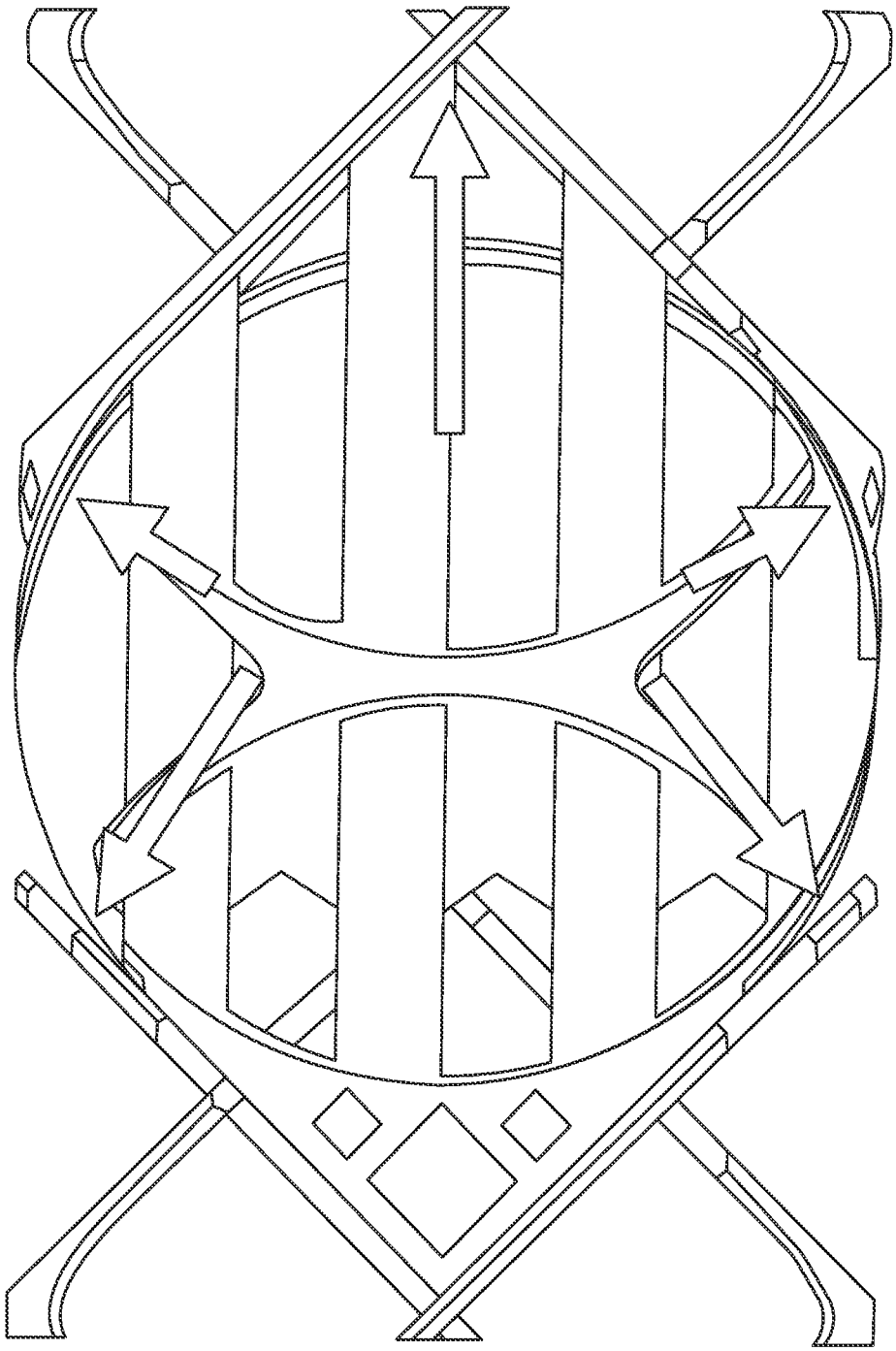
FIG. 12 is a side view of the module of FIGS. 10 and 11 showing the interlocking nature of the connection feature, according to one or more embodiments.
Figure 13:
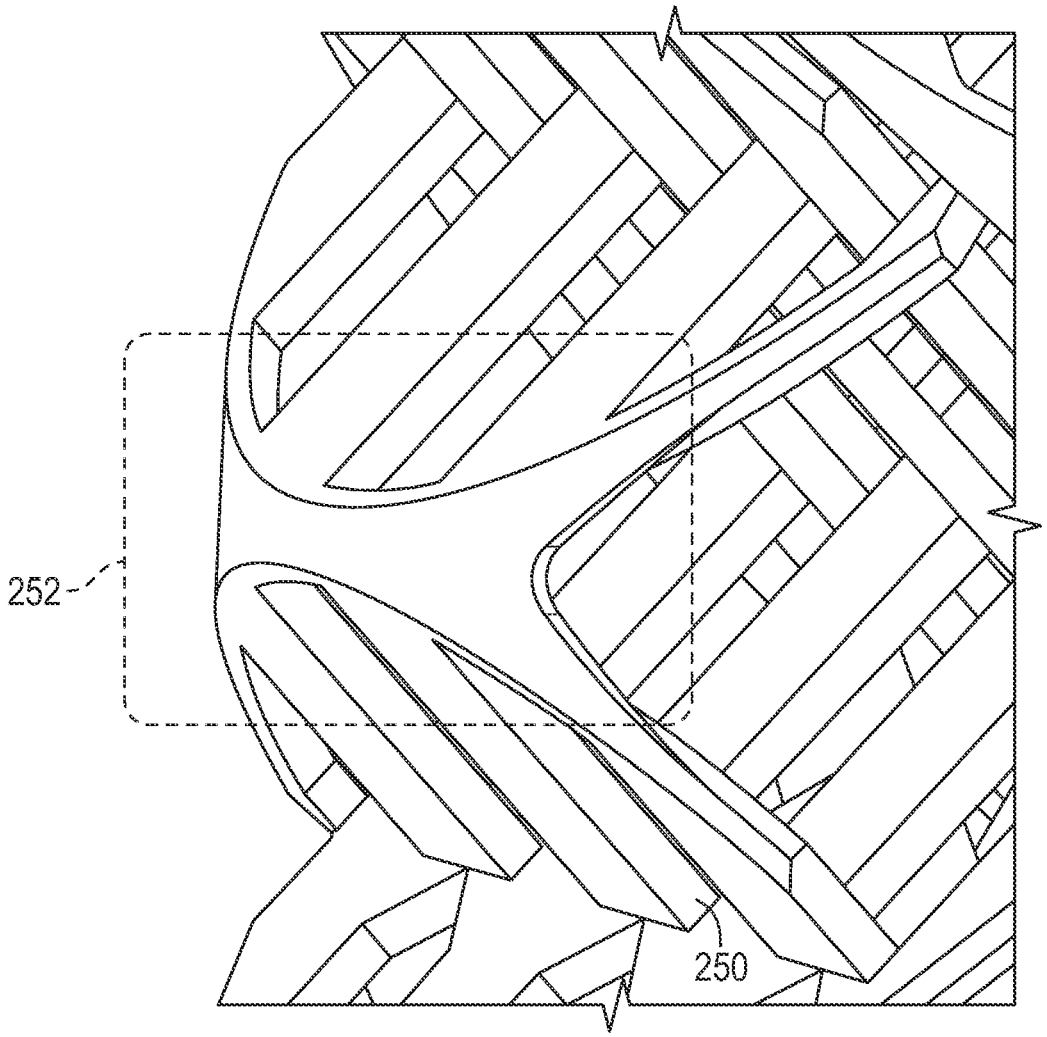
FIG. 13 is a close-up view of a disk joint, according to one or more embodiments.
Figure 14:
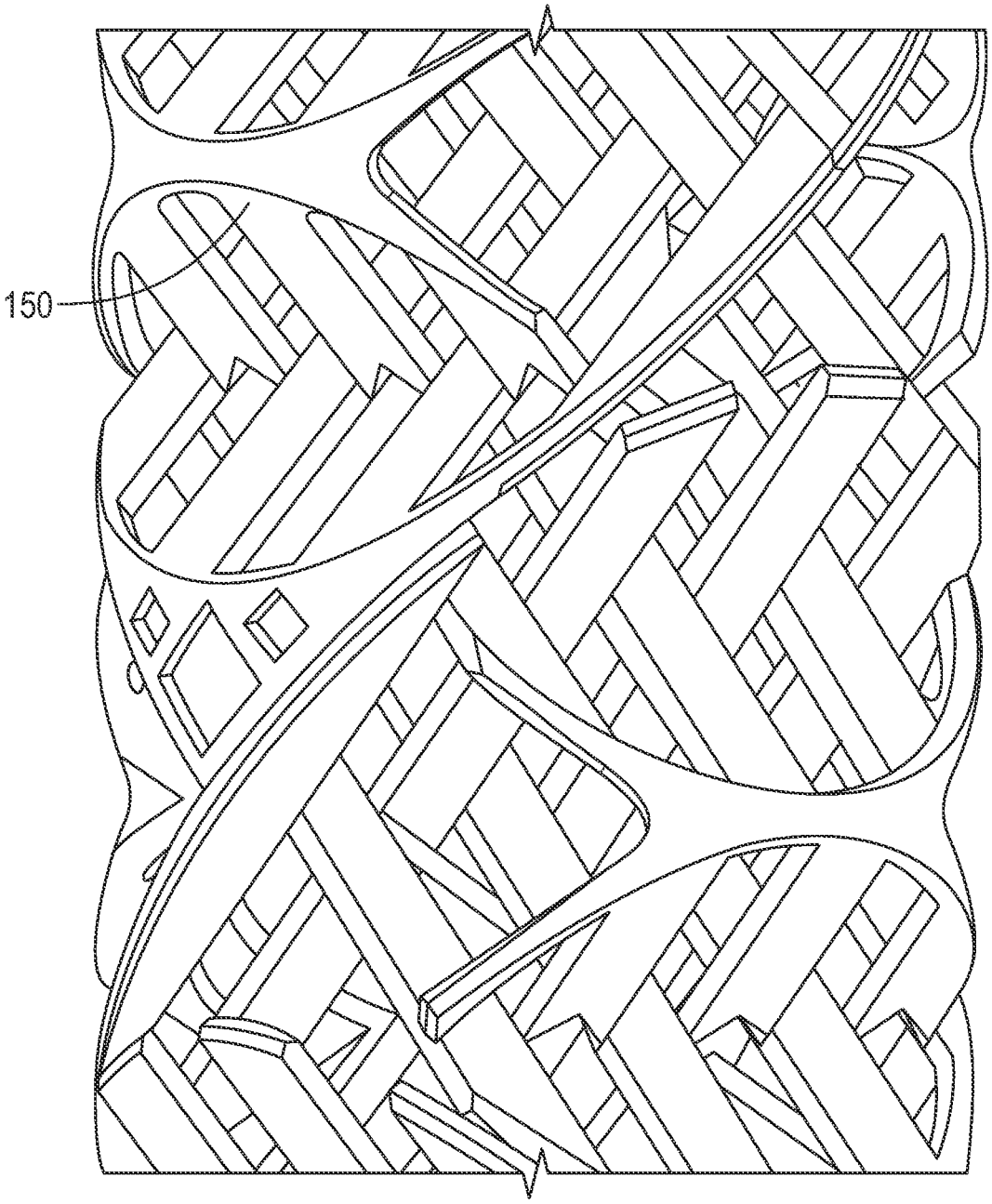
FIG. 14 is a perspective view of a mixing element showing connecting plates having a v-shape therein, according to one or more embodiments.
Figure 15:
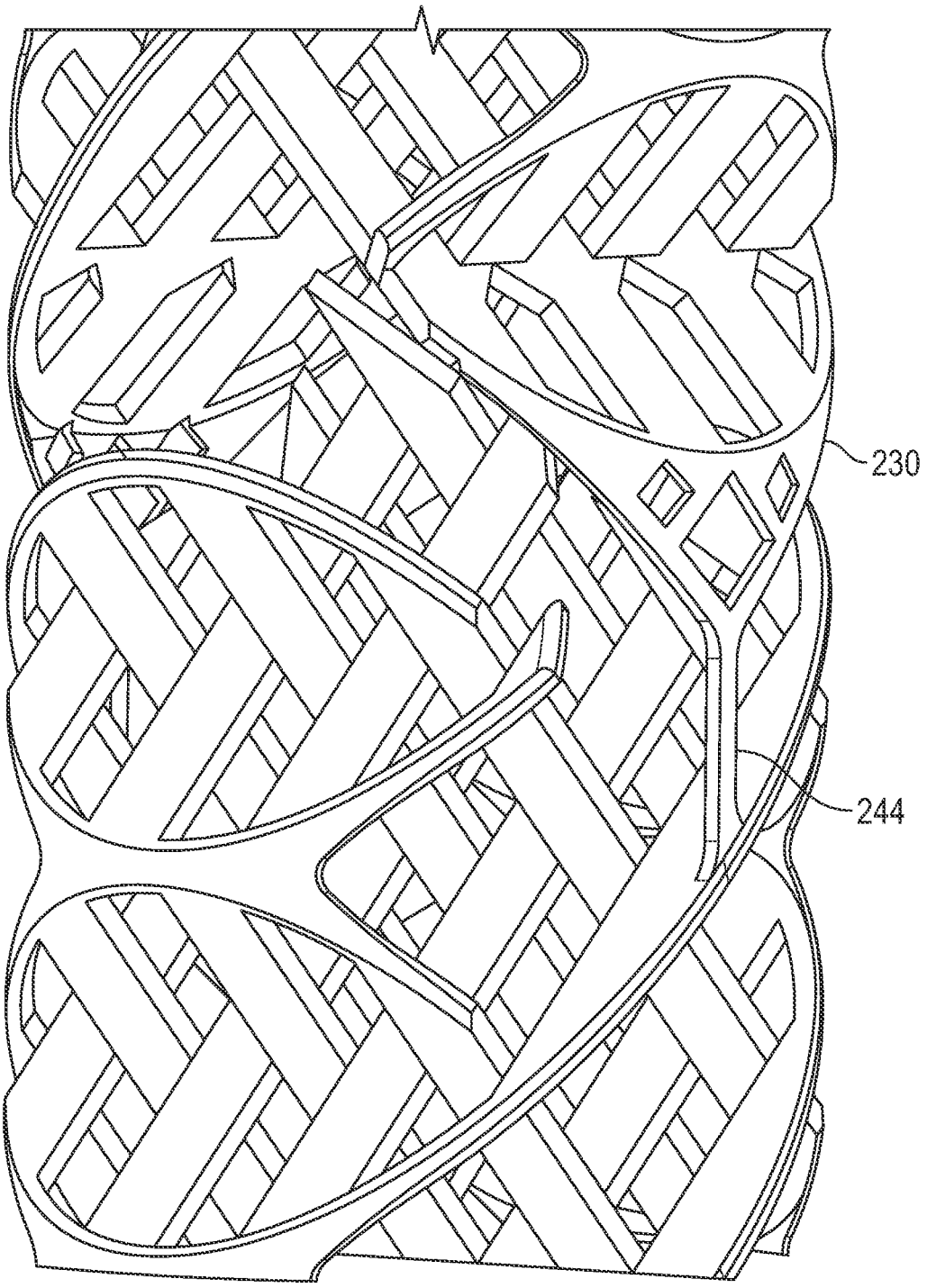
FIG. 15 is a perspective view of a mixing element, according to one or more embodiments.

Referring now to FIG. 10-13, another embodiment of a mixing element module 214 is shown. As shown, the mixing element module may be stackable like the module 114 described in FIGS. 5-7. The mixing element module 214 may include 2 pairs of crisscrossing blade disks 216, like the embodiment of FIGS. 5-7. However, in contrast to the module of FIGS. 5-7, the present embodiment may include a combination of blade disks where some of the blade disks have links at each end (e.g., lower blade disk pair) and some of the blade disks have links at a single end (e.g., upper blade disk pair). In addition, the present embodiment, may include a nesting base 230 on the bottom of each set of lower blade legs 222 rather than a ring base 130. That is, a support perch type element may be arranged below the blade legs 222 forming a nesting base 230 of the module 214 such that the module is adapted to be nestingly arranged on top of another module 214. That is, when placed on top of another similar module and arranged at 90 degrees to that module, the nesting base 230 may be adapted to nestingly seat in the crux of the lower pair of crisscrossing blade disks as shown in, for example, FIG. 12. In this embodiment, a disk joint 252 may be provided as shown in FIG. 13. This may be in lieu of a propped tie 142, but in other embodiments, a propped tie may be provided. As shown in FIGS. 10, 11, and 13, connecting plates 250 with a flat bottom may be provided. Alternatively, as shown in FIG. 14, connecting plates 150 with V-shaped notches at their bottom ends may be provided like those in module 114. As shown in FIG. 15, a propped nesting base 230 may be provided in one or more embodiments. That is, a strut or column 244 may be provided extending downward from the nesting base 230 to provide additional support therefor.

Figure 16E:
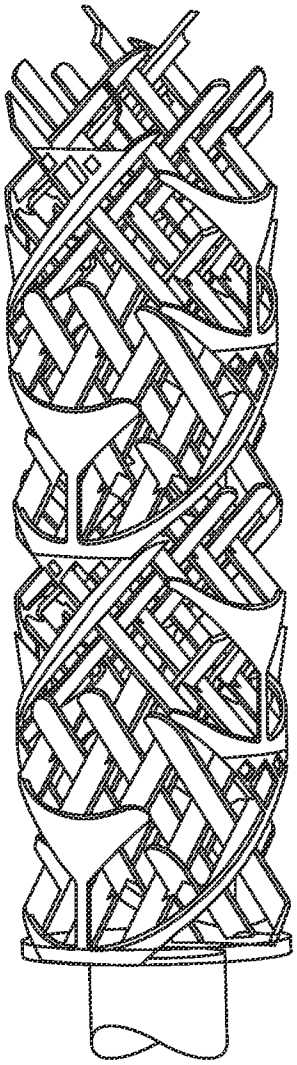
FIG. 16E is a perspective view of a mixing element, according to one or more embodiments.
Figure 16D:
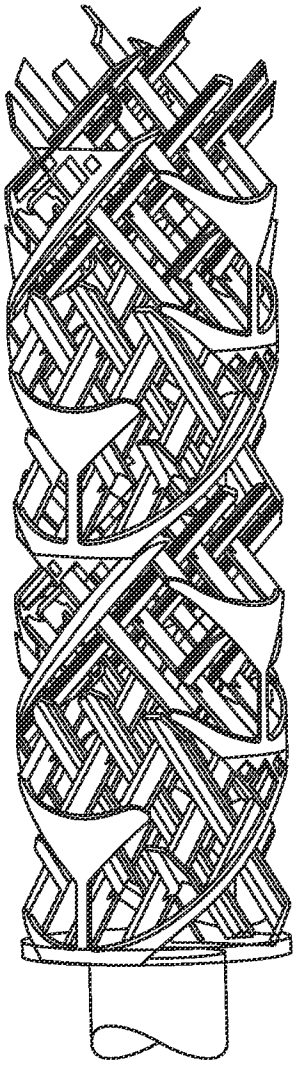
FIG. 16D is a perspective view of a mixing element, according to one or more embodiments.
Figure 16C:
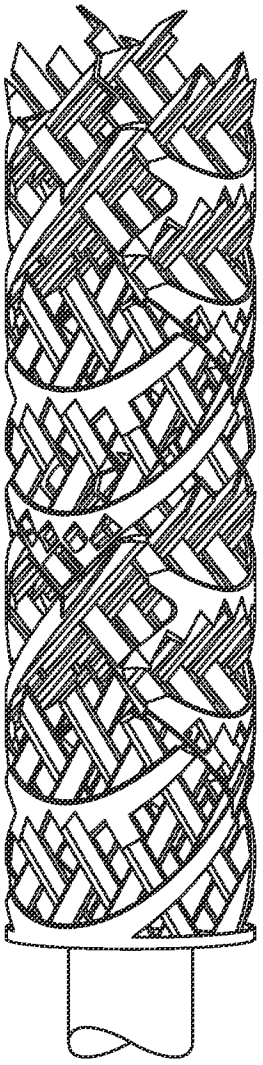
FIG. 16C is a perspective view of a mixing element, according to one or more embodiments.
Figure 16B:
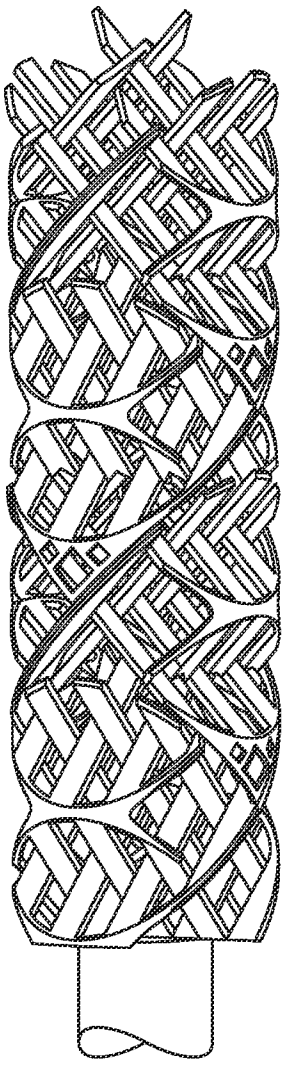
FIG. 16B is a perspective view of a mixing element, according to one or more embodiments.
Figure 16A:
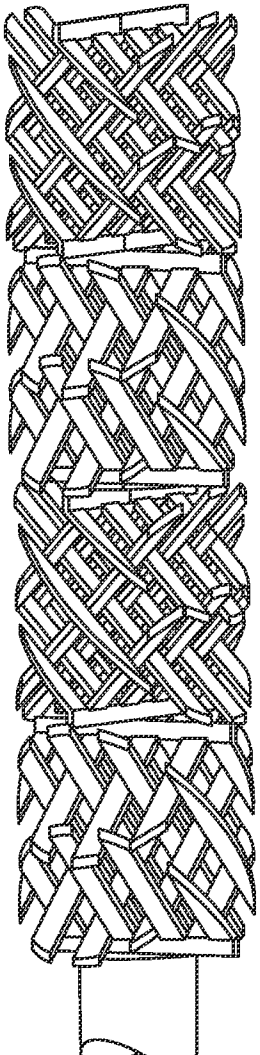
FIG. 16A is a perspective view of a mixing element, according to one or more embodiments.
Figures 17A, 17B, 17C, 17D, 17E:
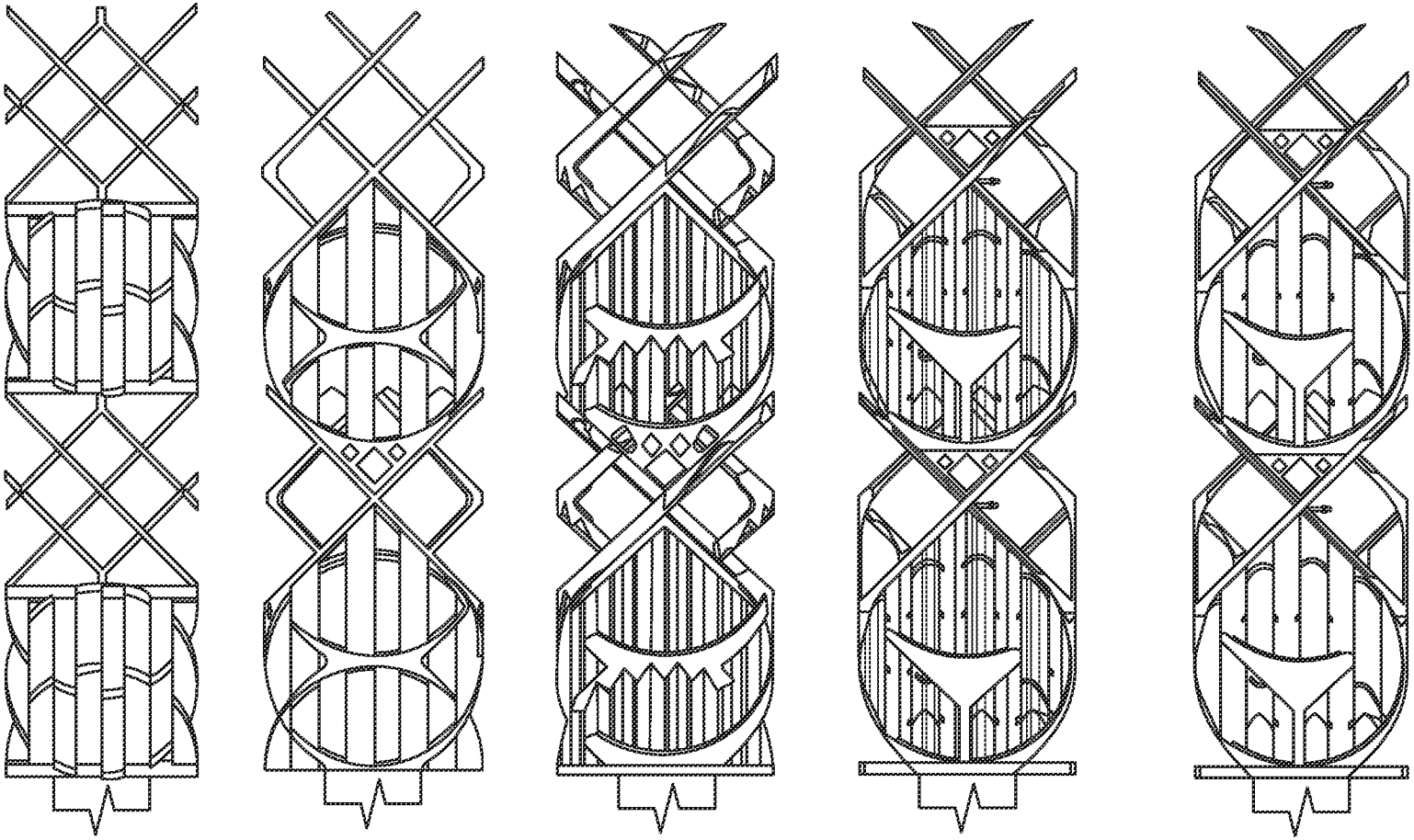
FIG. 17A is a front view of a mixing element, according to one or more embodiments.
FIG. 17B is a front view of a mixing element, according to one or more embodiments.
FIG. 17C is a front view of a mixing element, according to one or more embodiments.
FIG. 17D is a front view of a mixing element, according to one or more embodiments.
FIG. 17E is a front view of a mixing element, according to one or more embodiments.

FIGS. 16A-16E show a series of mixing element designs where FIG. 16A shows a mixing elements made up of blade sets. FIGS. 16B-16E include blade disks where ends of the blades are linked. FIGS. 16B/C show embodiments where the module includes a nesting base and FIGS. 16D/E show embodiments where the module includes a ring base adapted for seating on a ring and/or a like module. FIGS. 17A-17E show front views of the embodiments of 16A-16E.

It is to be appreciated that the particular designs and features of the mixing elements described herein may allow for additive manufacturing of the mixing elements without the need for excessive support material during the manufacturing process. That is, for example, for any given blade disk, the connected ends may provide a support point for additive manufacturing of the several blades in the disk without the need for any and/or excessive support material. Moreover, the propped tie, for example, may allow for manufacturing of the upper disks without the need for other support material. Still further, the particular design of the support perch and its relatively flat top surface may avoid the need for a starting module, for example. Instead, any and all modules may be the same and the starting module may be the same as all of the other modules. Still other advantages of the designs described herein may be apparent to those of skill in the art.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A static mixer, comprising:

a housing having an inlet and an outlet; and a mixing element module arranged within the housing and comprising:

a plurality of blade disk pairs arranged in crisscrossing fashion, each blade disk, of the pairs of blade disks, comprising a plurality of parallel extending and spaced apart blades; and for each blade disk, a first link connecting a first end of each of the plurality of parallel extending and spaced apart blades, wherein, at least one of the first links comprises a first ring base adapted to sleevably fit within the housing and another of the first links comprises a propped tie arranged above the first ring base and extending laterally around a periphery of a bottom edge of the plurality of parallel and spaced apart blades of a respective blade disk, the propped tie being supported off of the first ring base by a strut.

2. The static mixer of claim 1, wherein for one or more of the blade disks, a second end of each of the plurality of parallel extending and spaced apart blades are connected with a second link.

3. The static mixer of claim 1, wherein the first ring base comprises a substantially flat bottom edge.

4. The static mixer of claim 1, wherein the mixing element module comprises an upper disk pair and a lower disk pair and the first link of a first blade disk of the lower disk pair comprises a first ring base connecting bottom legs of the first blade disk and the first link of a second blade disk of the lower disk pair comprises a second ring base connecting bottom legs of the second blade disk.

5. The static mixer of claim 1, further comprising a support perch configured for supporting a second ring base of an adjoining mixing element module.

6. The static mixer of claim 5, wherein the support perch is arranged 90 degrees out of phase of the first ring base.

7. A static mixer of claim 5, wherein the support perch comprises a substantially flat top for receiving a substantially flat bottom of the second ring base of the adjoining mixing element module.

8. A static mixing element, comprising:

a plurality of mixing element modules, each module comprising:

a plurality of blade disk pairs arranged in crisscrossing fashion, each blade disk, of the pairs of blade disks, comprising a plurality of parallel extending and spaced apart blades;

for each blade disk, a first link connecting a first end of each of the plurality of parallel extending and spaced apart blades, wherein at least one of the first links comprises a ring base; and a support perch configured for supporting a ring base of an adjoining module.

9. The static mixing element of claim 8, wherein for one or more of the blade disks, a second end of each of the plurality of parallel extending and spaced apart blades are connected with a second link.

10. The static mixing element of claim 8, wherein the ring base comprises a substantially flat bottom edge.

11. The static mixing element of claim 8, wherein each module comprises an upper disk pair and a lower disk pair and the first link of a first blade disk of the lower disk pair comprises a first ring base connecting bottom legs of the first blade disk and the first link of a second blade disk of the lower disk pair comprises a second ring base connecting bottom legs of the second blade disk.

12. The static mixing element of claim 8, wherein at least one of the first links of each module comprises a propped tie.

13. The static mixing element of claim 8, wherein the support perch of each module is arranged 90 degrees out of phase of the ring base of that module.

14. The static mixing element of claim 8, wherein the support perch comprises a substantially flat top for receiving a substantially flat bottom of the ring base of the adjoining module.

15. A static mixer, comprising:

a housing having an inlet and an outlet; and a mixing element module arranged within the housing and comprising:

a plurality of blade disk pairs arranged in crisscrossing fashion, each blade disk, of the pairs of blade disks, comprising a plurality of parallel extending and spaced apart blades;

for each blade disk, a link connecting a first end of each of the plurality of parallel extending and spaced apart blades, wherein at least one of the links comprises a ring base; and a support perch configured for supporting a ring base of an adjoining module.

16. The static mixer of claim 15, wherein the ring base comprises a substantially flat bottom edge.

17. The static mixer of claim 15, wherein the mixing element comprises an upper disk pair and a lower disk pair and the link of a first blade disk of the lower disk pair comprises a first ring base connecting bottom legs of the first blade disk and the link of a second blade disk of the lower disk pair comprises a second ring base connecting bottom legs of the second blade disk.

18. The static mixer of claim 15, wherein the support perch of the mixing element module is arranged 90 degrees out of phase of the ring base thereof.

19. The static mixer of claim 15, wherein the support perch comprises a substantially flat top for receiving a substantially flat bottom of the ring base of the adjoining module.

* * * * *